US006311443B1

(12) United States Patent
Allazetta

(10) Patent No.: US 6,311,443 B1
(45) Date of Patent: Nov. 6, 2001

(54) PRE-MANUFACTURED DECK PANEL

(76) Inventor: Robert Allazetta, 1070 Washington St., Reno, NV (US) 89503

( * ) Notice: Subject to any disclaimer, the term of this patent is extended or adjusted under 35 U.S.C. 154(b) by 0 days.

(21) Appl. No.: 09/353,103

(22) Filed: Jul. 14, 1999

(51) Int. Cl.[7] ..... E04F 13/08

(52) U.S. Cl. ..... 52/392; 52/386; 52/387; 52/460; 52/480; 52/536; 52/582; 52/650.3; 403/354; 403/591.1; 403/592.1; 403/403.1

(58) Field of Search ..... 52/392, 386, 387, 52/460, 480, 536, 582, 650.3; 403/354, 591.1, 592.1, 403.1

(56) References Cited

U.S. PATENT DOCUMENTS

| | | | | |
|---|---|---|---|---|
| 5,339,581 | | 8/1994 | Schlickenmeyer | 52/177 |
| 5,361,554 | | 11/1994 | Bryan | 52/586.1 |
| 5,497,590 | * | 3/1996 | Counihan | 52/385 |
| 5,511,353 | * | 4/1996 | Jones | 52/536 |
| 5,671,575 | | 9/1997 | Wu | 52/480 |

* cited by examiner

*Primary Examiner*—Carl D. Friedman
*Assistant Examiner*—Christy M. Syres
(74) *Attorney, Agent, or Firm*—Skinner, Sutton, Watson & Rounds

(57) ABSTRACT

This invention provides an apparatus, method, and system to arrange a deck or balcony with the use of pre-manufactured deck panels. The deck panels are inexpensive, easy to install, remove, or add to, and only requires common framing hardware.

26 Claims, 6 Drawing Sheets

PRE-MANUFACTURED DECK PANEL

BACKGROUND OF THE INVENTION

1. Field of the Invention

This invention relates to deck panels; in particular, this invention relates to the use of pre-manufactured deck panels to arrange a deck or balcony in a parquet, parallel, or any other desired style.

2. State of the Art

Building or remodeling decks are the most popular do-it-yourself home improvement projects. Nearly two-thirds of all decks are do-it-yourself projects. However, these do-it-yourself decks require the use of large, long, heavy and bulky lumber, are not easy to install, remove, or add to, and require rare or many materials to build. Therefore, there exists a need for an efficient apparatus, method, and system for do-it-yourself decks.

Decks are common in homes because it adds a whole new dimension to a homeowner's life. Decks are used to entertain, sunbathe, outdoor dine, and relax. A deck is a place where you can carry out many of the same activities as in inside rooms, but it also allows for the added pleasure of enjoying those activities in fresh air and sunlight.

Easy do-it-yourself decks, such as this invention, enables a homeowner, having limited knowledge and tools of construction, to plan and build a superior product at a reasonable cost. Moreover, additions to the deck are easy so that should a homeowner have a limited budget, building in progression is not a problem. In this invention, each pre-manufactured deck panel is a structural unit with a frame and a nail strip on each side. The use of this deck panel will reduce the amount of large lumber necessary to build decks and is easy to install, remove, and add to. Moreover, the use of this system will only require common framing hardware and not rare materials. Furthermore, the use of pre-manufactured deck panels will allow a homeowner to plan a deck to his own specification either in a parquet, parallel, or any other desired pattern.

Lastly, it is possible to use this pre-manufactured deck panel on a variety of piers. It may be installed on a concrete pier set at a level height or a pier made with a beam to cover irregular terrain.

SUMMARY OF THE INVENTION

This invention provides an apparatus, method, and a system to arrange a deck or balcony. The preferred embodiment of this invention comprises:

- a surface and a base, the base and the surface each having a top, a bottom, a first side, and a second side;
- a plurality of lateral bars disposed on the surface;
- a plurality of frame rails peripherally bordering the base and attached to the plurality of lateral bars; and
- a plurality of nail strips attached to the plurality of frame rails.

A second aspect of this invention, a pre-manufactured deck panel, is a method for arranging the deck panel, comprising:

- preparing a finish grade;
- making a solid foundation to be received by the finish grade;
- securing a plurality of clips to the solid foundation;
- laying the deck panel between the plurality of clips with the surface facing upwardly and the plurality of nail strips mating; and
- disposing a trim between the deck panel.

A third aspect of this invention, a pre-manufactured deck panel, is a deck panel system, comprising:

- a finish grade to receive a solid foundation;
- a deck panel having:
  - a surface and a base, the base and the surface each having a top, a bottom, a first side, and a second side;
  - a plurality of lateral bars disposed on the surface;
  - a plurality of frame rails peripherally bordering the base and attached to the plurality of lateral bars; and
  - a plurality of nail strips attached to the plurality of frame rails.

DETAILED DESCRIPTION OF THE PREFERRED EMBODIMENT

Figure 1:
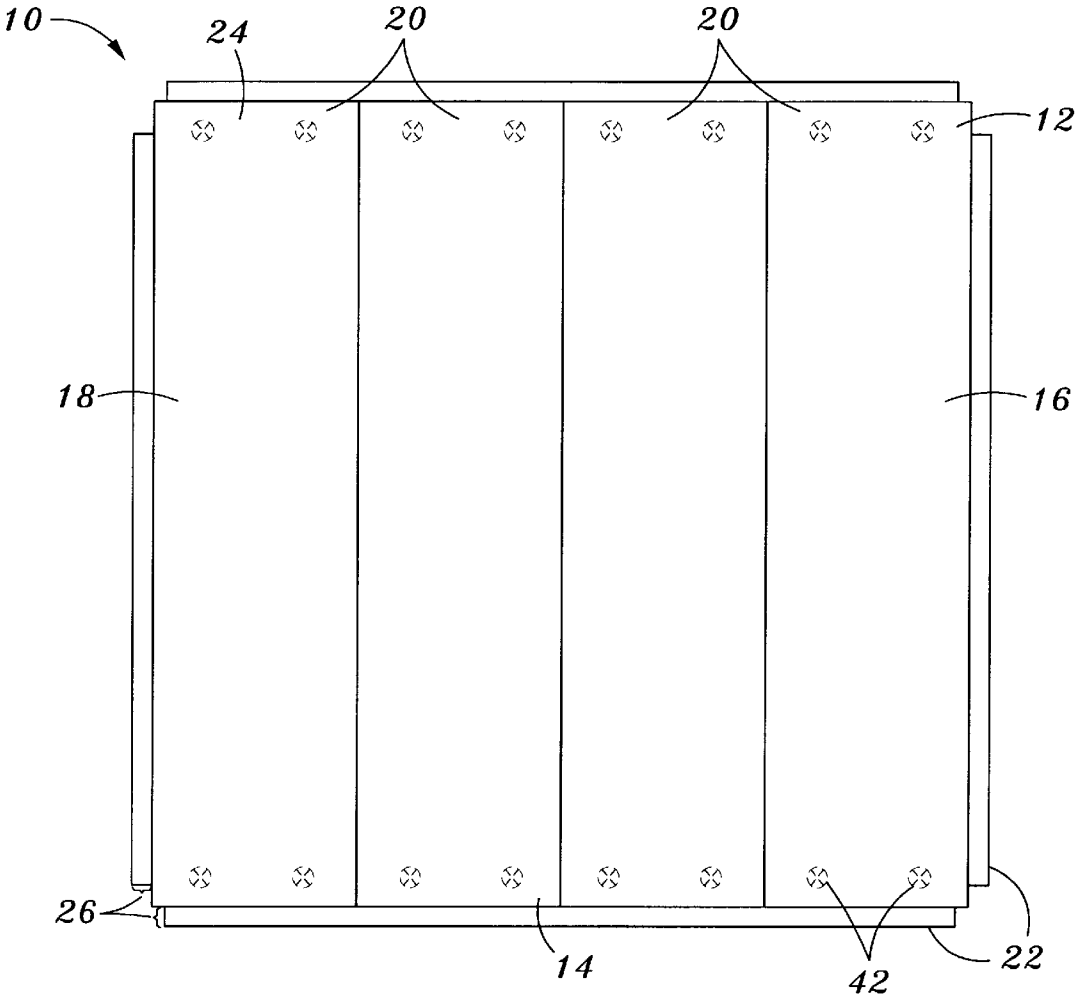
FIG. 1 is a view of the surface of a deck panel.

Referring to FIG. 1, the surface 12 of the deck panel 10 having a top 24, a bottom 14, a first side 16, and a second side 18. There are a plurality of lateral bars 20 disposed on the surface 12 and a plurality of nail strips 22 each defining a projecting protrusion 26. The first side 16 is substantially similar to the second side 18 and the top 24 is substantially similar to the bottom 14.

Figure 2:
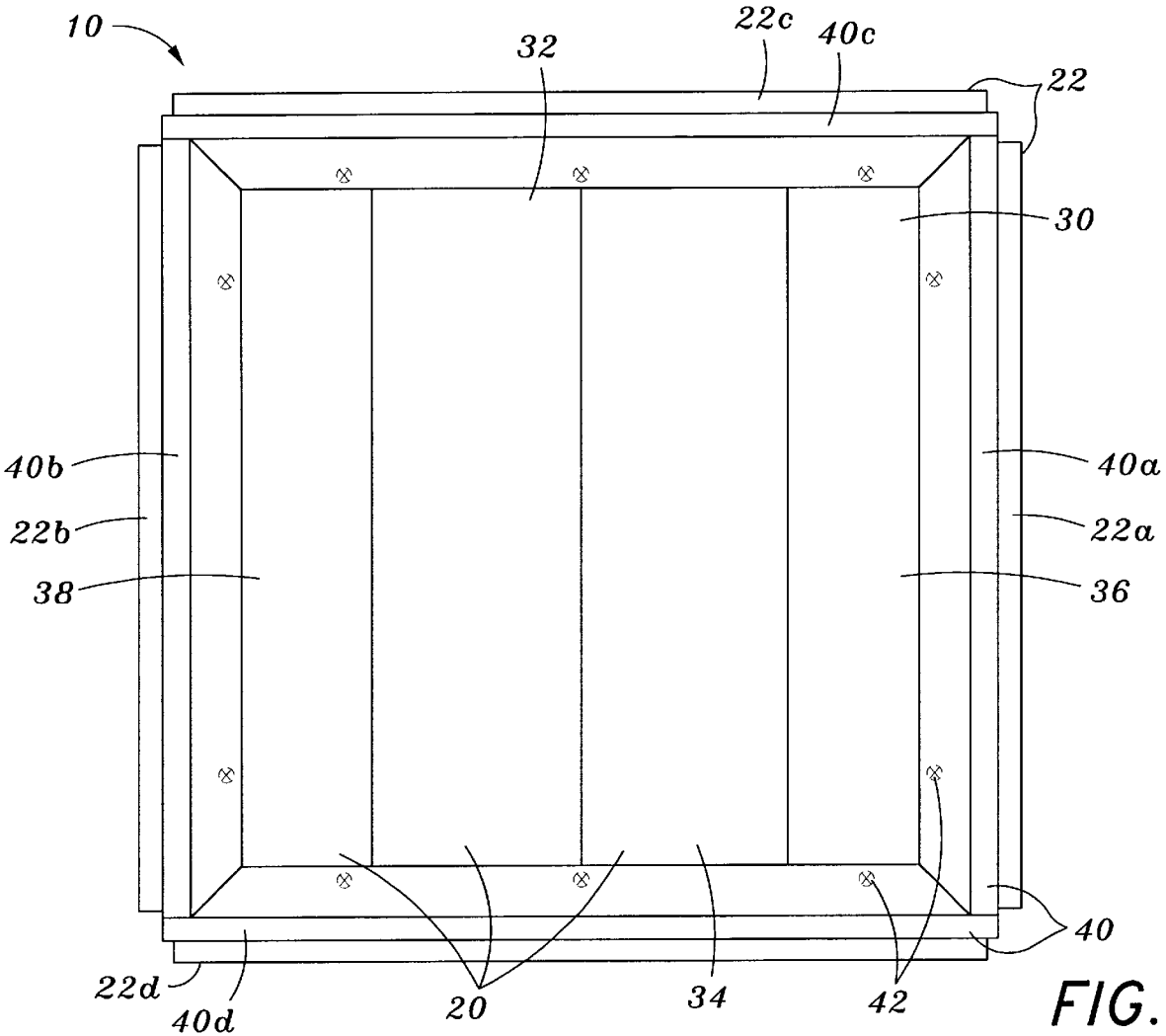
FIG. 2 is a view of the base of a deck panel.

Referring to FIG. 2, the base 30 of the deck panel 10, has a top 32, a bottom 34, a first side 36, and a second side 38. There are a plurality of frame rails 40 peripherally bordering the base 30 and attached to the lateral bars 20. A plurality of nail strips 22 are attached to the frame rails 40. The base 30 has a first frame rail 40*a* and a first nail strip 22*a* on the first side 36 of the base, a second frame rail 40*b* and a second nail strip 22*b* on the second side 38 of the base, a third frame rail 40*c* and a third nail strip 22*c* on the top 32 of the base, and a fourth frame rail 40*d* and a fourth nail strip 22*d* on the bottom 34 of the base. As shown in FIG. 1 and FIG. 2 in phantom, the preferred method to attach the frame rails to the lateral bars and the nail strip to the frame rails are by the use of screws 42. However, other affixing means may be used such as adhesives, like glue, nails, or other like affixing means.

Figure 3:
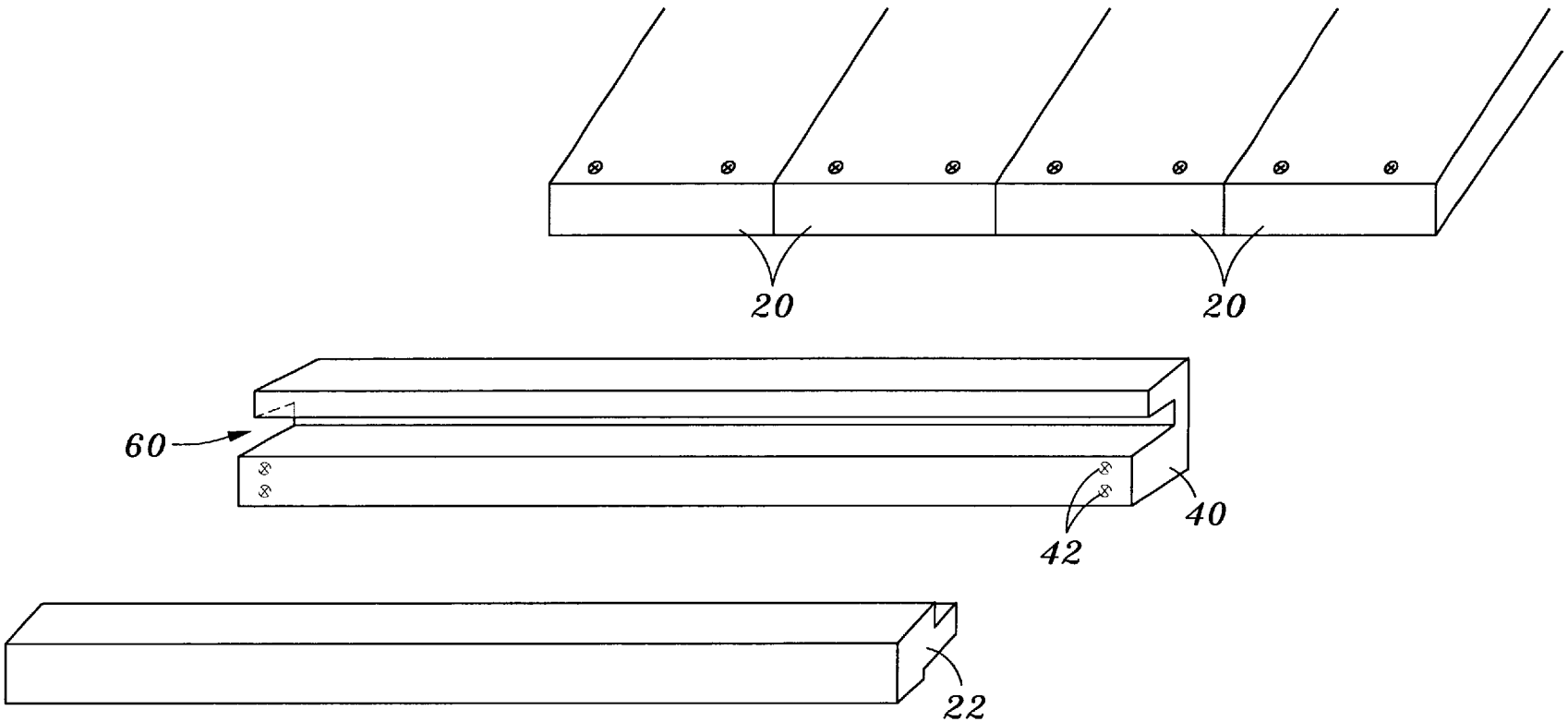
FIG. 3 is an exploded perspective view of the deck panel showing the connection of the nail frame, to the frame rail, to the lateral bars.

Referring to FIG. 3, the frame rails 40 each define a recess 60 therein where each nail strip 22 is splined into. When the nail strip 22 is splined into the frame rails 40, the nail strips 22 project beyond the lateral bars defining a projecting protrusion 26, as indicated in FIGS. 1 and 2. As FIG. 3 further indicates, the frame rails 40 are attached to the plurality of lateral bars 20.

Figure 4:
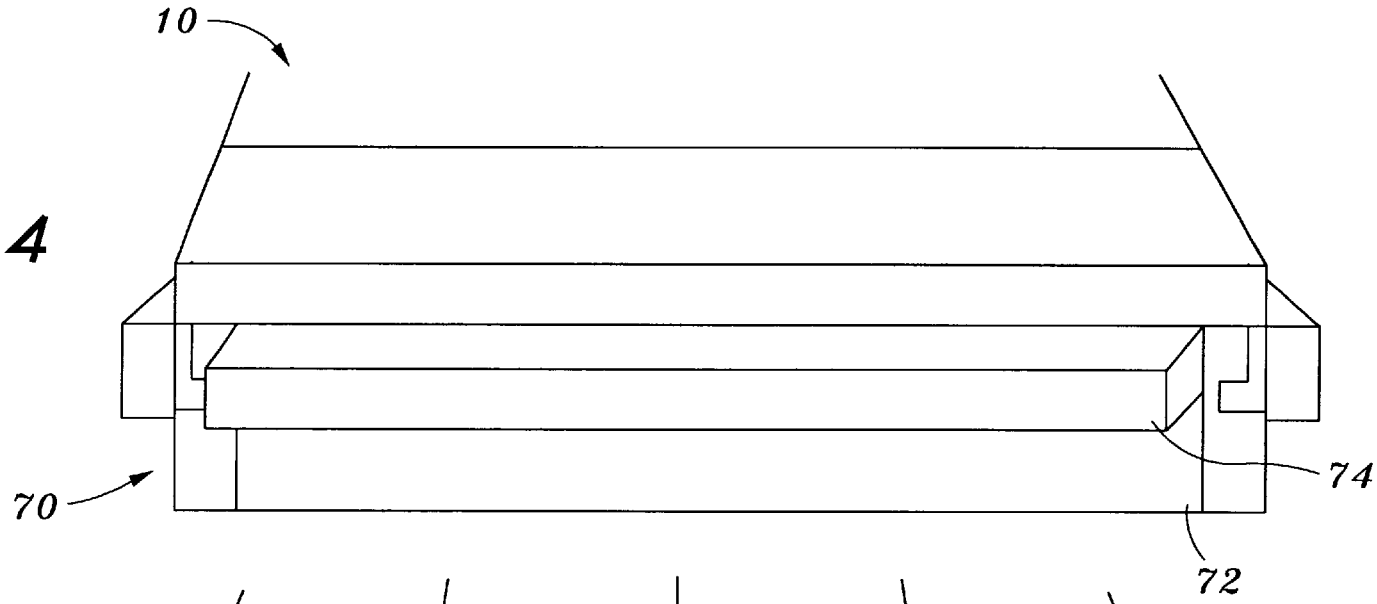
FIG. 4 is a perspective view of the first side of a deck panel.
Figure 5:
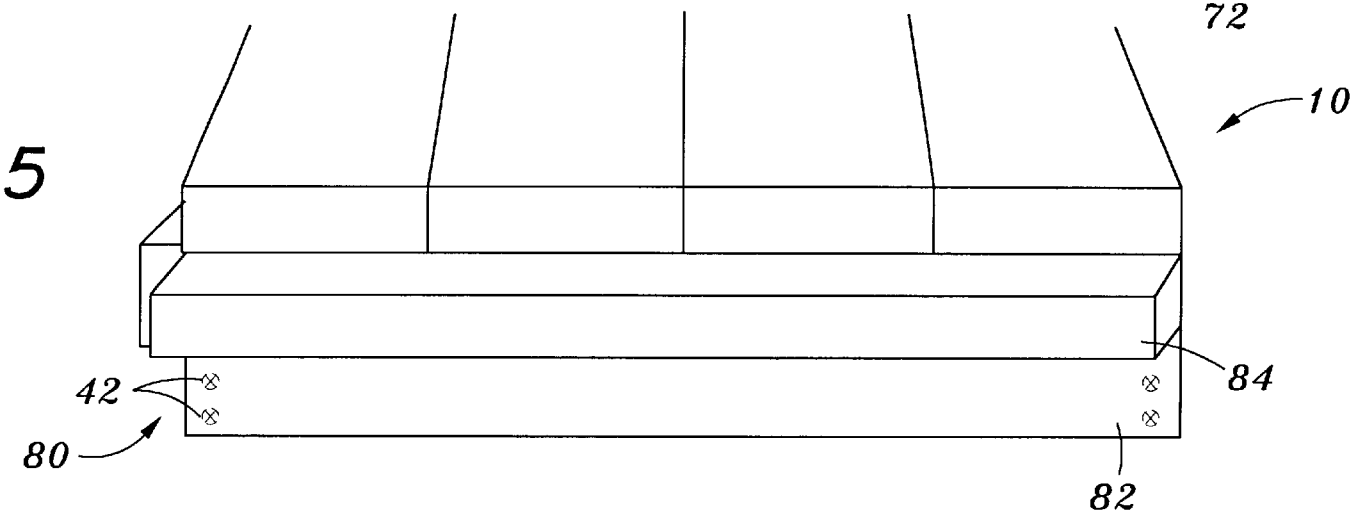
FIG. 5 is a perspective view of the top of a deck panel.

Referring to FIG. 4, a side view of the first side 70 of the deck panel 10, and FIG. 5, a side view of the top 80 of the deck panel 10. The frame rail 72 and the nail strip 74 on the first side 70 is shorter in length than the frame rail 82 and nail strip 84 on the top 80. Moreover, as shown in phantom in FIG. 5, the preferred method to connect each frame rail to the each other is through the use of screws 42. However, the frame rails can be attached to each other by the use of other affixing means such as an adhesive, like glue, nails, or other like affixing means.

Figure 6:
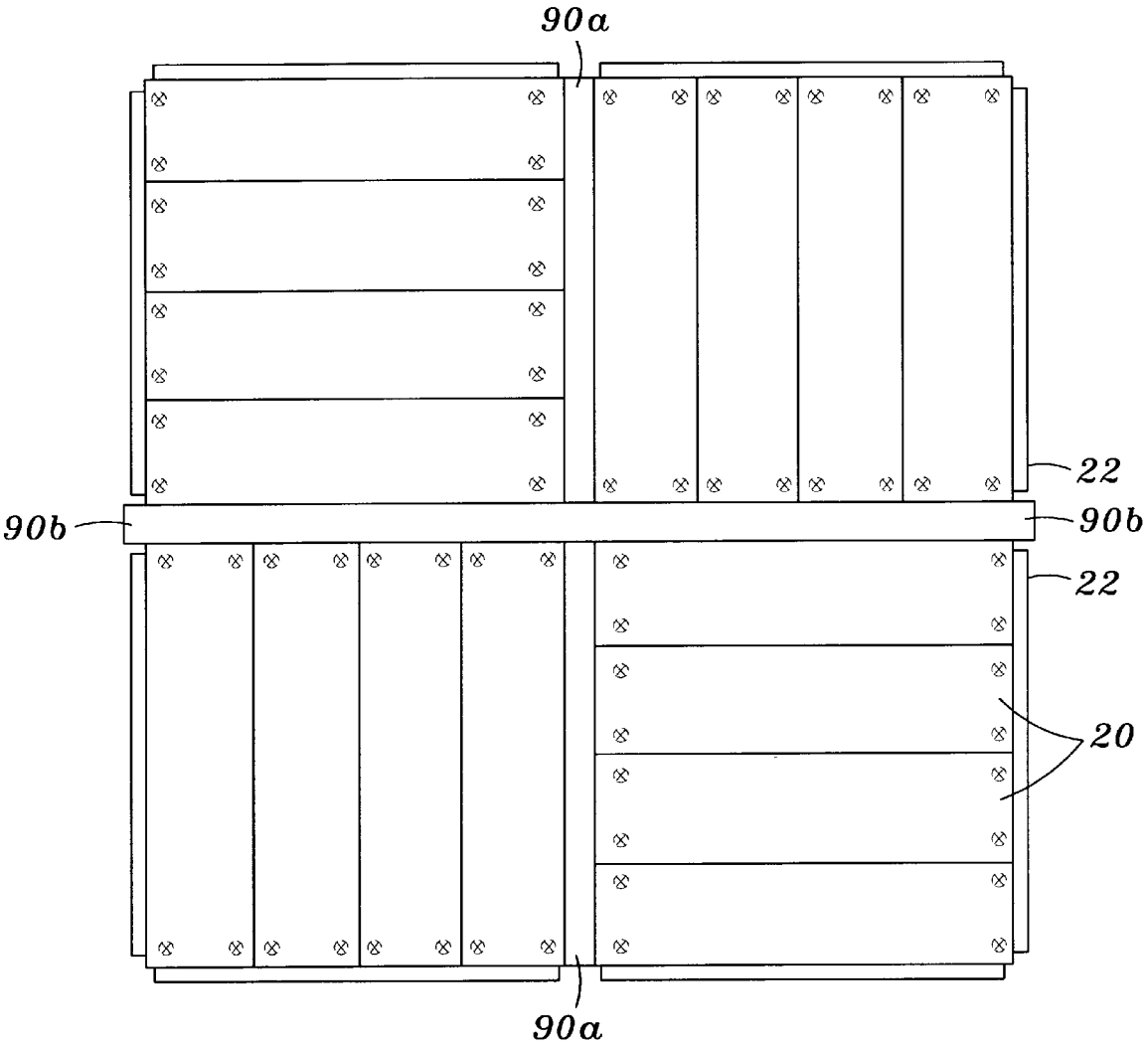
FIG. 6 is a surface view of a possible arrangement of a plurality of deck panels.

Referring to FIG. 6, the deck panel may be arranged in any position to form different patterns on a deck or balcony. The deck panels may be arranged to form a parquet, parallel, a combination of both, or any other desired style. The styles are formed by placing the plurality of lateral bars 20 in either the horizontal or vertical position with the nail strips 22 mating. To level and lock in the deck panels, disposed between the nail strips are a plurality of trims 90. The trims 90*a* on the first side or the second side of the deck panel are shorter in length than the trims on the top or bottom 90*b*.

The deck panels may be made from any type of wood, however, the preferred wood to use is Redwood since it is the strongest wood in nature. When preparing outdoor decks or balconies, it is preferred that the building materials be long lasting and is able to withstand environmental elements yet retain their symmetry and aesthetic purposes. Redwood has less volumetric and tangential shrinkage so that the deck panels will stay flat and straight with minimal warping, cupping, or checking. Redwood also has a grown-in resistance to decay and insects throughout its lumber. Finally, Redwood is able to absorb and retain all types of finishes because it has an open celled structure and contains little or no pitch or resins. Although Redwood is the preferred building material to use, the deck panel may be made from other types of woods such as Douglas fir-larch, Western cedar, Southern pine, Eastern hemlock, Hem-fir, Idaho white pine, Spruce-pine-fir, Englemann spruce-lodgepole pine, and the like.

Figure 7:
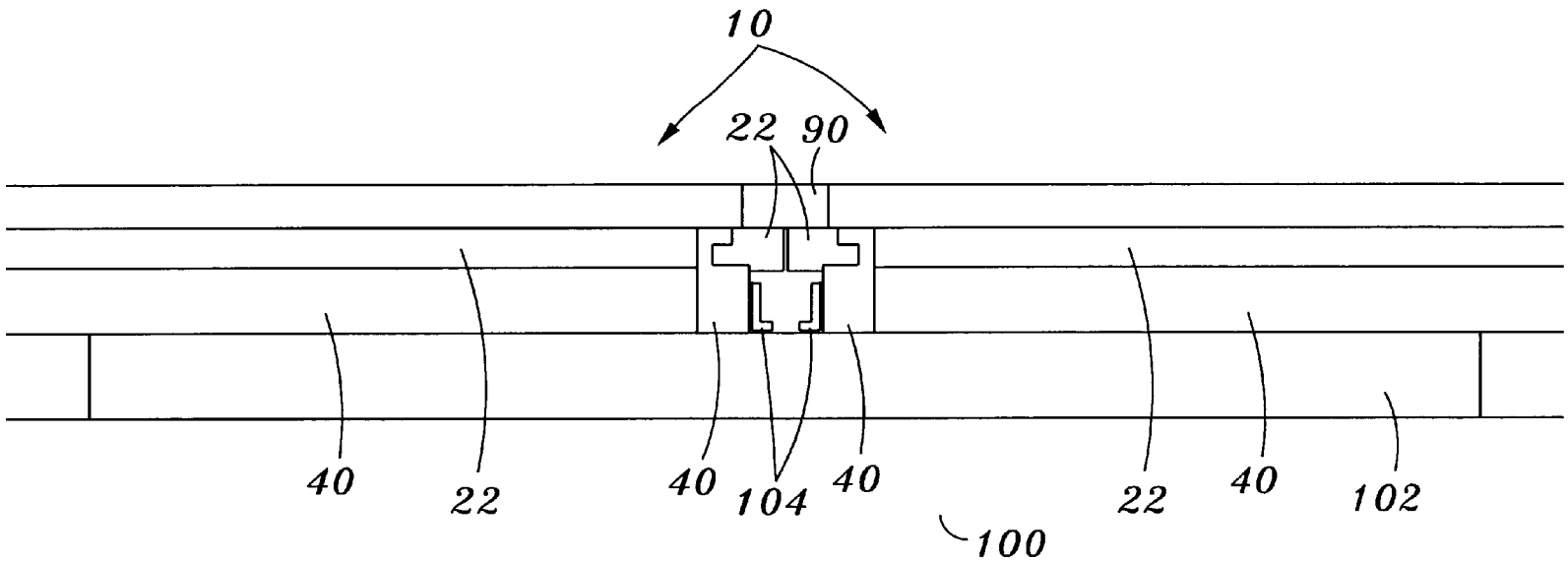
FIG. 7 is a side view of the arrangement of the deck panels as connected to a solid foundation.

This invention also provides a method for arranging the deck panel. As shown in FIG. 7, the method provides for preparing a finish grade 100 and making a solid foundation 102 to be received by the finish grade 100. Then securing a plurality of clips 104 to the finish grade 100 to receive the deck panels 10. The deck panels are then positioned between the plurality of clips with the surface facing upwardly and the plurality of nail strips 22 mating, and finally, disposing a trim 90 between the deck panel to level and deck secure the deck panels.

Furthermore, this invention provides for a method of making a deck to cover irregular terrain or a balcony comprising preparing a finish grade and making a solid foundation to be received by the finish grade. Then securing a plurality of clips to the solid foundation. A stable beam, having a first end and a second end, is received by the solid foundation. Disposing the first end between the plurality of clips, the second end receives the deck panel with the surface facing upwardly and the plurality of nail strips mating. Finally, the method provides for laying the trim between the deck panels to level and secure the deck panels.

The clips used to secure and arrange the deck panels are common framing hardware. The preferred clips to use are Simpson A-21 clips or the Simpson RTU-2 clips. However, any device that is able to be secure and arrange the deck panels may be used.

Although the preferred embodiment of this invention employs the use of a solid foundation, the solid foundation is not necessary. As long as the finish grade is sturdy enough to secure the clips, the deck panels may be placed directly onto the finish grade. However, this is not advisable due to weather conditions and acts of God that may cause the deck panels to warp, become unstable, or cause the deck to be not level. Moreover, it is preferred that the solid foundation be a concrete pier, although other forms of solid foundations may be used, such as wood piers, or other like piers.

Lastly, this invention provides for a deck panel system comprises a finish grade to receive a solid foundation; a deck panel having a surface and a base, the base and the surface each having a top, a bottom, a first side, and a second side; a plurality of lateral bars disposed on the surface; a plurality of frame rails peripherally bordering the base and attached to the plurality of lateral bars; and a plurality of nail strips attached to the plurality of frame rails. The frame rails each define a recess therein wherein each nail strip is splined into the recess of each frame rail. The plurality of nail strips each project beyond the lateral bars defining a projecting protrusion where a plurality of trims are received by the projecting protrusion. The first side is substantially similar to the second side and the top is substantially similar to the bottom.

As shown in FIG. 4, a side view of the first side 70 of the deck panel 10, and FIG. 5, a side view of the top 80 of the deck panel 10. The frame rail 72 and the nail strip 74 on the first side 70 is shorter in length than the frame rail 82 and nail strip 84 on the top 80. And as shown in FIG. 6, the trims 90*a* on the first side or the second side of the deck panel are shorter in length than the trims 90*b* on the top or bottom.

Finally, the deck panel system comprises preparing the finish grade to receive a solid foundation; securing a plurality of clips to the solid foundation; laying the deck panel between the plurality of clips with the surface facing upwardly and the plurality of nail strips mating; and positioning a trim above the projecting protrusion. The deck panel system further allows for securing the plurality of clips to the solid foundation; disposing a plurality of sturdy beams between the plurality of clips at a first end; positioning each deck panel on a second end of the sturdy beam with the surface facing upwardly and the plurality of nail strips mating; and laying the trim above the projecting protrusion.

This invention has been described by reference to specific examples and embodiments, which will bring alternative embodiments, modifications and variations to the minds of those skilled in the art. The appended claims are intended to encompass all such alternatives, modifications, and variations.

I claim:

1. A deck panel, comprising:

a surface and a base, the base and the surface each having a top, a bottom, a first side, and a second side;

a plurality of lateral bars disposed on the surface;

a plurality of frame rails peripherally bordering the base and attached to the plurality of lateral bars;

a plurality of nail strips attached to the plurality of frame rails;

the base having a first frame rail and a first nail strip on the first side of the base, a second frame rail and a second nail strip on the second side of the base, a third frame rail and a third nail strip on the top of the base, and a fourth frame rail and a fourth nail strip on the bottom of the base; and wherein the first frame rail, and the second frame rail are shorter in length than the third frame rail and the fourth frame rail.

2. The deck panel of claim 1 wherein the frame rails each define a recess therein.

3. The deck panel of claim 2 wherein each nail strip is splined into the recess of each frame rail.

4. The deck panel of claim 3 wherein the plurality of nail strips each project beyond the lateral bars defining a projecting protrusion.

5. The deck panel of claim 1, further comprising a plurality of trims, each trim received by the projecting protrusion.

6. The deck panel of claim 1 wherein the first frame rail and the second frame rail are substantially similar in length, and the first nail strip and the second nail strip substantially similar in length.

7. The deck panel of claim 1 wherein the third frame rail and the fourth frame rail are substantially similar in length, and the third nail strip and fourth nail strip are substantially similar in length.

8. The deck panel of claim 1 wherein the surface further comprises a first trim disposed on the first side of the surface, and a second trim disposed on the second side of the surface, the first trim and the second trim substantially similar in length.

9. The deck panel of claim 1 wherein the surface further comprises a third trim disposed on the top of the surface, and a fourth trim disposed on the bottom of the surface, the third trim and fourth trim substantially similar in length.

10. The deck panel of claim 9 wherein the first trim and the second trim are shorter in length than the third and fourth trim.

11. A method for arranging deck panels, each deck panel having a surface and a plurality of nail strips, comprising the steps of:

preparing a finish grade;

making a solid foundation to be received by the finish grade;

securing a plurality of clips to the solid foundation;

laying each deck panel between the plurality of clips with the surface facing upwardly and the plurality of nail strips mating; and leveling and locking in the deck panels by disposing trims between the deck panels.

12. A method for arranging deck panels, each deck panel having a surface and a plurality of nail strips forming a projecting protrusion, comprising the steps of:

preparing a finish grade;

making a solid foundation to be received by the finish grade;

securing a plurality of clips to the solid foundation;

disposing a sturdy beam between the plurality of clips at a first end;

positioning each deck panel on a second end of the sturdy beam;

facing the surface upwardly;

mating the nail strips; and laying a trim above the projecting protrusion.

13. A deck panel system, comprising:

a finish grade to receive a solid foundation;

a deck panel having:

a surface and a base, the base and the surface each having a top, a bottom, a first side, and a second side;

a plurality of lateral bars disposed on the surface;

a plurality of frame rails peripherally bordering the base and attached to the plurality of lateral bars;

a plurality of nail strips attached to the plurality of frame rails;

the base having a first frame rail and a first nail strip on the first side of the base, a second frame rail and a second nail strip on the second side of the base, a third frame rail and a third nail strip on the top of the base, and a fourth frame rail and a fourth nail strip on the bottom of the base; and wherein the first frame rail, and the second frame rail are shorter in length than the third frame rail and the fourth frame rail.

14. The deck panel system of claim 13 wherein the frame rails each define a recess therein.

15. The deck panel system of claim 14 wherein each nail strip is splined into the recess of each frame rail.

16. The deck panel system of claim 15 wherein the plurality of nail strips each project beyond the lateral bars defining a projecting protrusion.

17. The deck panel system of claim 13, further comprising plurality of trims, each trim received by the projecting protrusion.

18. The deck panel system of claim 17 wherein the first frame rail and the second frame rail are substantially similar in length, and the first nail strip and the second nail strip substantially similar in length.

19. The deck panel of claim 13 wherein the third frame rail and the fourth frame rail are substantially similar in length, and the third nail strip and fourth nail strip are substantially similar in length.

20. The deck panel system of claim 13 wherein the surface further comprises a first trim disposed on the first side of the surface, and a second trim disposed on the second side of the surface, the first trim and the second trim substantially similar in length.

21. The deck panel system of claim 13 wherein the surface further comprises a third trim disposed on the top of the surface, and a fourth trim disposed on the bottom of the surface, the third trim and fourth trim substantially similar in length.

22. The deck panel system of claim 21 wherein the first trim and the second trim are shorter in length than the third and fourth trim.

23. A deck panel, comprising:

a surface and a base, the base and the surface each having a top, a bottom, a first side, and a second side;

a plurality of lateral bars disposed on the surface;

a plurality of frame rails peripherally bordering the base and attached to the plurality of lateral bars;

a plurality of nail strips attached to the plurality of frame rails;

the base having a first frame rail and a first nail strip on the first side of the base, a second frame rail and a second nail strip on the second side of the base, a third frame rail and a third nail strip on the top of the base, and a fourth frame rail and a fourth nail strip on the bottom of the base; and wherein the first nail strip and the second nail strip are shorter in length than the third nail strip and the fourth nail strip.

24. A deck panel, comprising:

a surface and a base, the base and the surface each having a top, a bottom, a first side, and a second side;

a plurality of lateral bars disposed on the surface;

a plurality of frame rails peripherally bordering the base and attached to the plurality of lateral bars;

wherein the base having a first frame rail and a first nail strip on the first side of the base, a second frame rail and a second nail strip on the second side of the base, a third frame rail and a third nail strip on the top of the base, and a fourth frame rail and a fourth nail strip on the bottom of the base;

wherein the first nail strip and the second nail strip are shorter in length than the third nail strip and the fourth nail strip; and wherein the frame rails each define a recess that receives a splined nail strip.

25. A deck panel system, comprising:

a finish grade to receive a solid foundation;

a deck panel having:

a surface and a base, the base and the surface each having a top, a bottom, a first side, and a second side;

a plurality of lateral bars disposed on the surface;

a plurality of frame rails peripherally bordering the base and attached to the plurality of lateral bars;

a plurality of nail strips attached to the plurality of frame rails;

the base having a first frame rail and a first nail strip on the first side of the base, a second frame rail and a second nail strip on the second side of the base, a third frame rail and a third nail strip on the top of the base, and a fourth frame rail and a fourth nail strip on the bottom of the base; and wherein the first nail strip and the second nail strip are shorter in length than the third nail strip and the fourth nail strip.

26. A deck panel system, comprising:

a finish grade to receive a solid foundation;

a deck panel having:

a surface and a base, the base and the surface each having a top, a bottom, a first side, and a second side;

a plurality of lateral bars disposed on the surface;

a plurality of frame rails peripherally bordering the base and attached to the plurality of lateral bars;

wherein the base having a first frame rail and a first nail strip on the first side of the base, a second frame rail and a second nail strip on the second side of the base, a third frame rail and a third nail strip on the top of the base, and a fourth frame rail and a fourth nail strip on the bottom of the base;

wherein the first nail strip and the second nail strip are shorter in length than the third nail strip and the fourth nail strip; and wherein the frame rails each define a recess that receives a splined nail strip.

* * * * *